US006616364B2

(12) United States Patent
Katz et al.

(10) Patent No.: US 6,616,364 B2
(45) Date of Patent: Sep. 9, 2003

(54) CONVERTIBLE SURFACE CONTACTING IMPLEMENT

(76) Inventors: Robert Katz, 3570 Ridgewood, Apt. 305, Montreal, Quebec (CA), H3V 1C2; Sylvain Duchesne, 5338 Chabot, Montréal, Québec (CA), H2H 1Y8

( * ) Notice: Subject to any disclaimer, the term of this patent is extended or adjusted under 35 U.S.C. 154(b) by 0 days.

(21) Appl. No.: 09/809,492

(22) Filed: Mar. 16, 2001

(65) Prior Publication Data

US 2002/0131806 A1 Sep. 19, 2002

(51) Int. Cl.[7] ..... A46B 5/02

(52) U.S. Cl. ..... 401/6; 401/195; 401/48; 401/196; 15/244.1; 15/176.4; 15/176.2

(58) Field of Search ..... 401/6, 196, 265, 401/266, 195, 48; 15/244.1, 176.2, 176.1, 176.4, 176.5; 16/425, 426

(56) References Cited

U.S. PATENT DOCUMENTS

| | | | | | |
|---|---|---|---|---|---|
| 2,772,434 A | | | 12/1956 | Solomon | |
| 4,483,636 A | | | 11/1984 | Meyer | |
| 4,728,210 A | | | 3/1988 | Barish | |
| 5,388,700 A | | | 2/1995 | Per-Lee | |
| 5,615,962 A | | * | 4/1997 | Staub | 401/266 |
| 5,785,443 A | | * | 7/1998 | Rubin | 401/6 |
| 6,129,469 A | | * | 10/2000 | Messer et al. | 401/6 |
| 6,210,057 B1 | | * | 4/2001 | Yannaci et al. | 401/6 |
| 6,244,776 B1 | | * | 6/2001 | Wiley | 401/6 |

* cited by examiner

*Primary Examiner*—David J. Walczak

(57) ABSTRACT

A convertible surface contacting implement having a head member and a long handle. The head member has a base, and a surface contacting member carried by the base. The head member forms a short-handled implement with the base acting as a short handle. A first connector is provided on the base and a second connector is provided on one end of the long handle. The second connector cooperates with the first connector to detachably connect the long handle to the base to form a long-handled implement. The implement may be a brush or an applicator. Preferably, the base of the head member is hollow to carry a liquid dispersed to the surface contacting member.

24 Claims, 3 Drawing Sheets

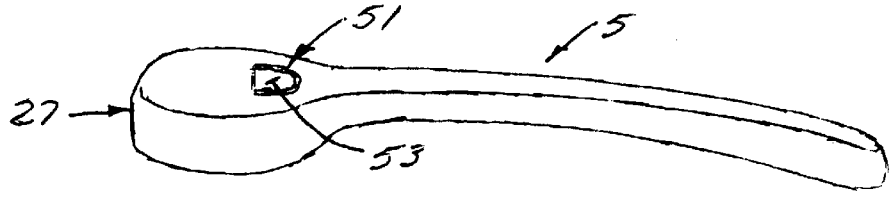
FIG. 1
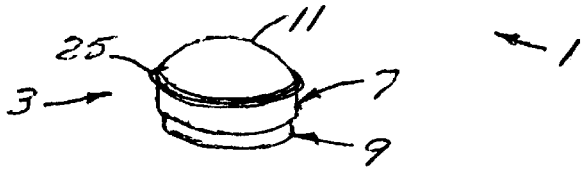
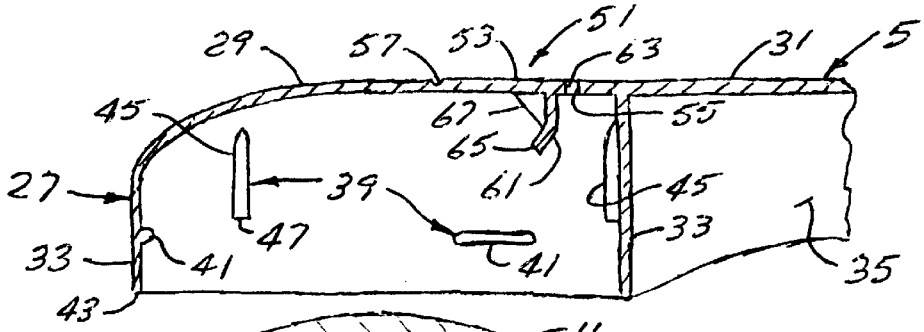
FIG. 2
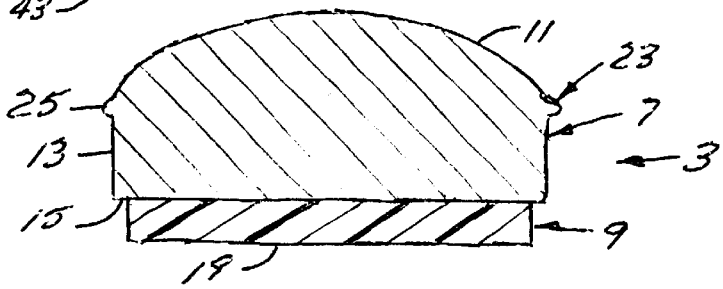
FIG. 3
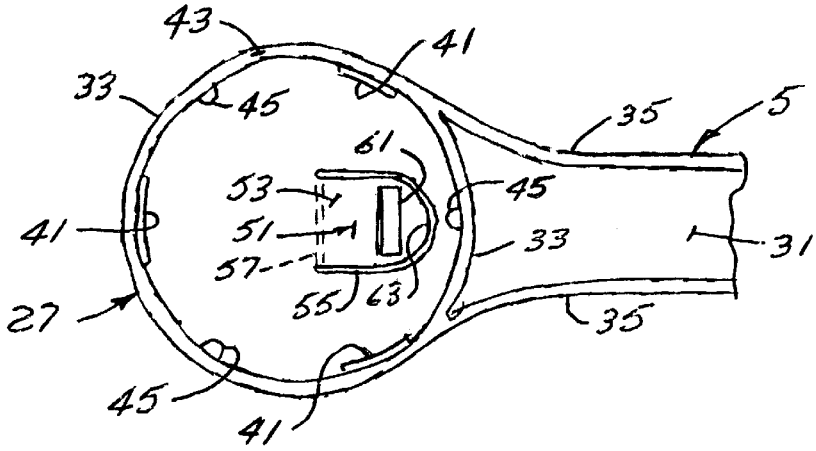

CONVERTIBLE SURFACE CONTACTING IMPLEMENT

BACKGROUND OF THE INVENTION

1. Field of the Invention

This invention is directed toward a surface contacting implement.

The invention is more particularly directed toward a surface contacting implement that is convertible between a long-handled implement and a short-handled implement.

2. Description of the Related Art Including Information Disclosed Under CFR §§1.97–1.99

When a person is washing it is desirable to have a long-handled, surface contacting implement, such as a long handled wash brush, available so that the person can wash their own back. A long-handled wash brush is awkward to use however in washing other parts of a person's body. A second, short-handled wash brush is usually used to wash the other body parts.

It is also known to have a surface contacting implement, such as a wash brush, that has its own supply of washing liquid. The wash brush has a container and dispenses the liquid from the container to the washing means carried by the brush.

It is also known to have a surface contacting implement, such as an applicator, that has its own supply of skin lotion such as sun-tan lotion. The applicator has a container that dispenses the lotion from the container to an applicator member carried by the applicator.

The known surface contacting implements, with a container, either have a short handle or a long handle but not both.

SUMMARY OF THE INVENTION

It is the purpose of the present invention to provide a single, long-handled, surface contacting implement that is readily convertible to a short-handled, surface contacting implement when needed so as to eliminate the need for two separate implements.

In accordance with the present invention there is provided a long-handled, surface contacting implement having a head member and a long handle. The head member has a base and surface contacting means carried by the base. The surface contacting means can be a sponge, a set of bristles, or the like. First connecting means are provided on the head member, preferably on the base. Second connecting means are provided at one end of the long handle. The second connecting means cooperates with the first connecting means to detachably connect the one end of the long handle to the head member. This provides a long-handled implement allowing a person to reach all parts of his back with the implement. If the person requires a short-handled implement to contact other parts of his body, the long handle can be detached from the head member. The person then grips the base of the head member, which base forms a short handle. Thus, the head member alone forms a short-handled implement.

Preferably, the base of the head member is hollow to provide a container for holding a liquid. The liquid could be a washing liquid such as soap. A metering opening in the base supplies the liquid in measured amount to the surface contacting means carried by the base.

The invention is particularly directed toward a convertible implement having a head member and a long handle. The head member has a base and surface contacting means carried by the base. The head member forms a short-handled implement with the base acting as a short handle. First connecting means are provided on the base and second connecting means are provided on one end of the long handle. The second connecting means cooperate with the first connecting means to detachably connect the long handle to the base to form a long-handled implement.

The base of the head member preferably is hollow to provide a container for holding a liquid. An opening in the base meters the liquid to the surface contacting means.

BRIEF DESCRIPTION OF THE DRAWINGS

FIG. 1 is an exploded, perspective, view of the convertible implement;

FIG. 2 is a detailed, exploded, cross-sectional view of the implement;

FIG. 3 is a bottom, detail, view of the long handle;

DESCRIPTION OF THE PREFERRED EMBODIMENTS

Figure 4:
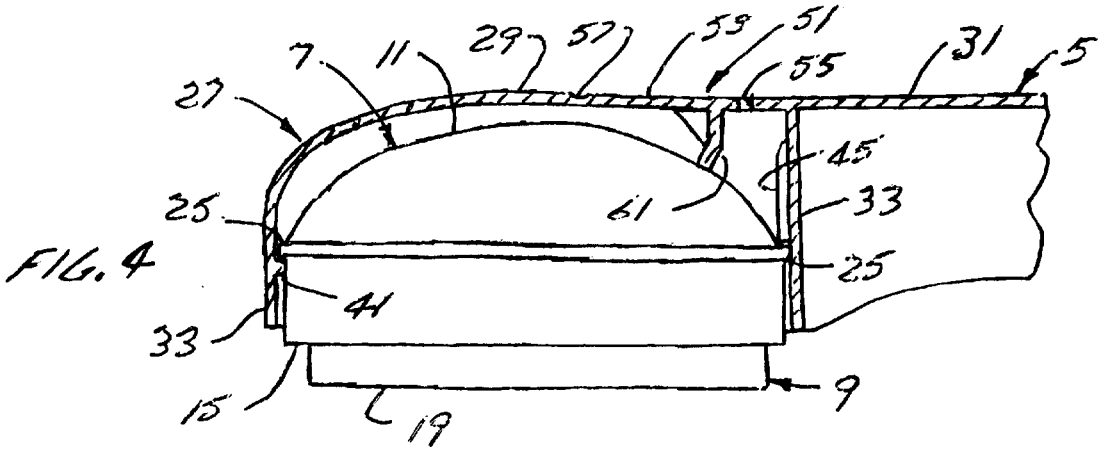
FIG. 4 is a cross-section, detailed view with the long handle connected to the head member.

The convertible surface contacting implement 1, as shown in FIGS. 1 to 4, has a head member 3 and a long handle 5. The long handle 5 is at least three times the length of the head member 3 as shown in FIG. 1. The head member 3 has a base 7 and a surface contacting member 9 held by, and projecting below, the base 7. The base 7 can be a solid member, as shown, with a top surface 11, a cylindrical side surface 13 and a flat bottom surface 15. The top surface 11 is preferably domed as shown. The surface contacting member 9 comprises a sponge 19 mounted on the flat bottom 15.

First connecting means 23 are provided on the base 7. The first connecting means 23 are in the form of a flange 25 encircling the side 13 of the base 7 near the top of the side, the flange 25 generally parallel with the bottom 15 of the base 7, and extending radially outwardly.

The head member 3, described above, can be gripped and used alone as a short-handled, surface contacting, implement, such as a washing brush, with the base 7 acting as a short handle. A person grips the base 7, and more particularly the side 13 of the base below the flange 25, with the fingers to manipulate the base and the surface contacting member 9 carried by the base.

The long handle 5 has a cap 27 at one end sized to fit over the base 7. The cap 27 has a top wall 29 that merges smoothly into the top wall 31 of the handle 5 and a circular side wall 33 that merges smoothly into the side walls 35 of the handle. Second connecting means 39 are provided on the cap 27 for cooperating with the first connecting means 23 on the base 7 to detachably connect the long handle 5 to the head member 3. The second connecting means 39 includes abutments 41 extending radially inwardly from the inner surface of the side wall 33 of the cap 27 near the bottom edge 43 of the side wall. Three abutments 41 are shown, equally spaced apart about the sidewall 33. The second connecting means 39 also includes three stops 45 extending radially inwardly from the inner surface of the sidewall 33. The stops 45 are equally spaced apart and equidistant between the abutments 41. The bottom 47 of the stops 45 are spaced just above the top of the abutments 41 a distance equal to, or slightly greater than, the thickness of the flange 25 on the head member 3. The stops 45 are preferably elongated in the vertical direction, when viewing the drawings, to provide stiffness to the side wall 33.

The head member 3 is mounted within the cap 27 of the handle 5 by pushing it up within the side wall 33 of the cap to have the flange 25 pass by the abutments 41 to be locked between the top of the abutments 41 and the bottoms 47 of the stops 45 as shown in FIG. 4. When the head member 3 is mounted within the cap 27, the surface contacting member 9 is located below the cap 27 and the top 11 of the base 7 is spaced slightly below the top 29 of the cap 27.

An ejector 51 is provided in the top wall 29 of the cap 27 of the handle 5 for pushing the head member 3 out from within the cap 27. The ejector 51 comprises a flap 53 formed in the top wall 33 of the cap 27 by a unshaped slot 55. A straight shallow groove 57 in the top surface of the top wall 29 can join the ends of the slot 55 to provide a hinge for the flap 53. The flap 53 is located in the top wall 29 near the top wall 31 of the handle 5 with the groove 57 farthest from the handle 5. An ejecting finger 61 extends down from the flap 53 near its front edge 63. The bottom edge 65 of the finger 61 abuts the top 11 of the head member 3 when the head member is mounted within the cap 27 as shown in FIG. 4. A stiffening rib 67 extends between the back of the finger 61 and the bottom of the flap 53. Pressing down on the flap 53 near its front edge 63 will cause the finger 61 to push the head member 3 down moving the flange 25 on the head member 3 past the abutments 41 to allow quick and easy removal of the head member 3 from the handle 5.

When the long handle 5 is attached to the base 7 of the head member 3, a long-handled, surface contacting, implement is provided. When the long handle 5 is removed, the head member 3 alone is used as a short-handled, surface contacting, implement, with the base 7 forming the short handle.

The implement 1 can be used as a wash brush providing both long and short handled wash brushes. The implement can also be used as an applicator to apply lotion to a person such as sun-tan lotion. The lotion is applied to the surface contacting member 9 and the implement is used in either the long or short handled versions to apply the lotion on a person's body. The implement could also be used as a paint brush, in either long or short handled versions. The surface contacting member 9 has been described as a sponge. It could however comprise a set of bristles, a pad or layers of absorbent material, or the like.

Figure 5:
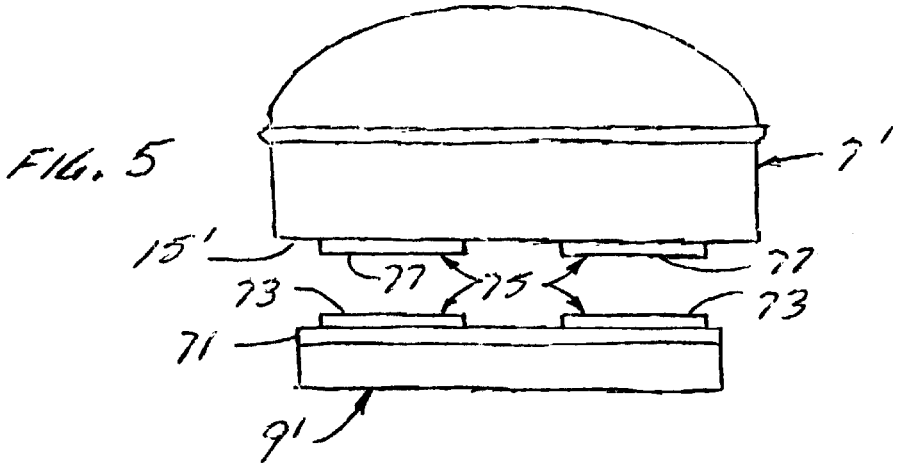
FIG. 5 is a detailed, cross-section, exploded view of another embodiment of the implement.

The surface contacting member 9 has been described as permanently attached to the bottom 15 of the base 7. However it could be detachably mounted on the base 7 so that different types of surface contacting members 9 could be used depending on what the implement is to be used for. For example as shown in FIG. 5, the surface contacting member 9', such as a sponge, could be permanently attached to one side of a thin rigid support 71. The other side of the support 71 could carry one 73 of hook and eye type fastening means 75, such as Velcro, with the other 77 of the hook and eye type fastening means 75 attached to the bottom 15' of the base 7'. Thus the support 71, carrying the surface contacting member 9' could be detachably connected to the base 7' and easily replaced. Other types of suitable fastening means 75 could be employed.

Figure 6:
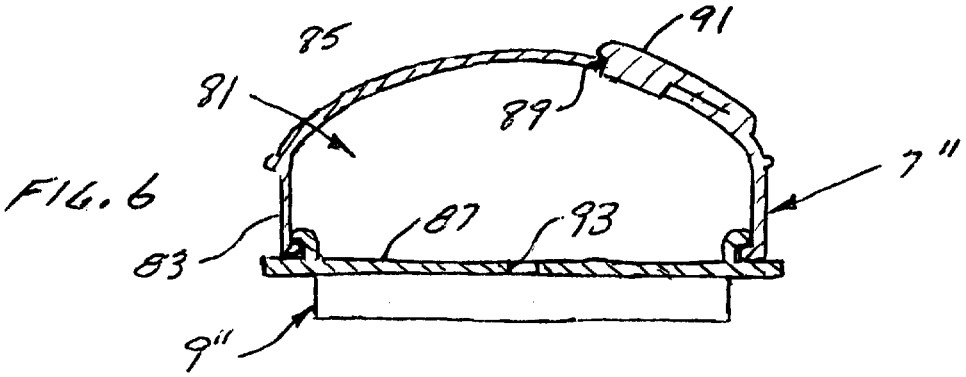
FIG. 6 is a cross-section view of a preferred embodiment of the head member.

In a preferred embodiment, the base 7" of the head member 3 is hollow, as shown in FIG. 6, to provide a container 81 for holding a liquid such as soap, sun-tan lotion, or the like. The base 7" has a cylindrical side wall 83, a top wall 85 that is preferably domed, and a flat bottom wall 87. The bottom wall 87 is separate from the side wall 83 to facilitate manufacture and is preferably permanently attached to the side wall 83. A liquid inlet 89, for use in filling the container, is provided in the top wall 85 closed by a closure 91 that is connected to the outside of the top wall 85. The closure 91 frictionally fits in the inlet 89 to close it. Liquid passes from the container 81 into the surface contacting member 9", mounted on the bottom wall 87, through at least one metering opening 93 in the bottom wall 87 of the base 7". The opening 93 controls the flow of the liquid from the container 81 to the surface contacting member 9" of the implement.

The bottom wall 87 has been described as being permanently attached to the side wall 83. However, with suitable seal means, it could be detachably connected to the side wall. When detachably connected, a plurality of bottom walls 87, each with a different type of surface contacting member 9" attached to them, could be provided so the surface contacting member could be changed to the use desired. Alternatively, with the bottom wall permanently attached to the side wall, the surface contacting member could be permanently attached to a rigid support, as shown in FIG. 5, which in turn is detachably connected to the bottom wall 87 of the base 7".

Figure 7:
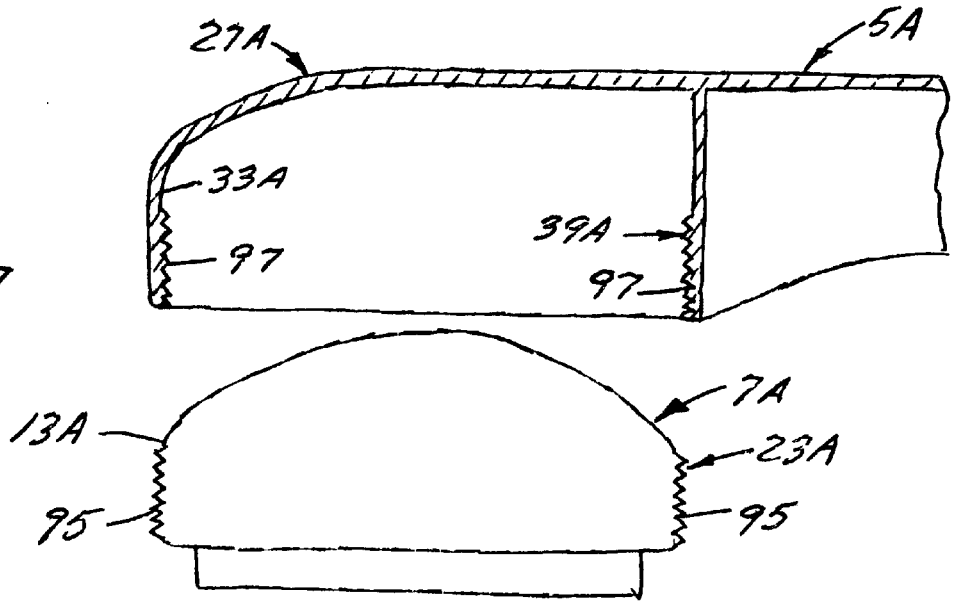
FIG. 7 is a detailed, cross-section, exploded view of yet another embodiment of the implement.

The connecting means between the long handle 5 and the head member 3 has been described as a snap-on, resilient-type of connection. However other connecting means between the handle and head member can be employed. For example, the first connecting means 23A on the base 7A can comprise external threads 95 on the side wall 13A as shown in FIG. 7. The second connecting means 39A can comprise internal threads 97 on the interior of the side wall 33A of the cap 27A on the long handle 5A, the side wall 33A being formed as an annular member. The threads 95, 97 allow the long handle 5A to be threaded onto the head member 3A to form a long-handled, surface contacting, implement. Removal of the long handle 5A, by unthreading it from the head member 3A, allows the head member 3A to be used alone as a short-handled, surface contacting, implement. The connecting means in the form of threads can be used on a solid or hollow base. Other suitable connecting means between the long handle and the head member can be employed.

The head member 3, when used alone as a short-handled, surface contacting, implement, has been has been described as being gripped by side wall 13 below the flange 25 on the base. The base 7 could also be shaped, both in the top wall and the side wall, to provide a better handle shape to grip the base 7.

The long handle 5 and the base 7 are preferably made from molded plastic material, the material being resilient enough to allow the second connecting means 39 on the long handle 5 some movement to snap over the first connecting means 23 on the base 7.

I claim:

1. A convertible surface contacting implement having: a head member; a long handle, with the long handle having a length at least three times the length of the head member; the head member having a base and surface contacting means connected to the base; the base hollow to form a container for liquid, the base having a metered opening for dispensing the liquid to the surface contacting means; the base forming a short handle; first connecting means on the base and second connecting means on one end of the long handle; the implement, with the head member connected to the long handle with the first and second connecting means, forming a long handled implement with the long handle held to dispense liquid from the container through the surface contacting means; the long handled implement convertible to a short handled implement by separating the head member from the long handle and holding the base of the head member to dispense liquid from the container through the surface contacting means.

2. An implement as claimed in claim 1 wherein the surface contacting means is detachably mounted on the base.

3. An implement as claimed in claim 2 wherein the long handle has a hollow cap at the one end, the cap having a top wall and a aide wall, the second connecting means on the inside of the side wall, the head member mounted within the cap and the second connecting means cooperating with the first connecting means on the head member to retain the head member within the cap.

4. An implement as claimed in claim 3 wherein the cap has ejector means for ejecting the head member from within the cap.

5. An implement as claimed in claim 4 wherein the ejector means comprises a flap formed in the top wall of the cap, the flap having an ejecting finger at its free end to contact the head member.

6. An implement as claimed in claim 3 wherein the second connecting means comprise a set of abutments extending radially inwardly from the inner surface of the side wall of the cap and a set of stops extending radially inwardly from the inner surface of the side wall, the stops located just above the abutments; the first connecting means comprising a circular flange on the head member, the flange located between the abutments and the stops when the head member is connected to the handle.

7. An implement as claimed in claim 6 wherein the cap has ejector means for ejecting the head member from within the cap.

8. An implement as claimed in claim 7 wherein the ejector means comprise, a flap formed in the top wall of the cap, the flap having an ejecting finger at its free end to contact the head member; the flap, when pushed down, pushing the flange on the head member past the abutments on the cap.

9. An implement as claimed in claim 2 wherein the handle has ejector means for ejecting the head member from the handle to separate the head member from the handle.

10. An implement as claimed in claim 1 wherein the long handle has a hollow cap at the one end, the cap having a top wall and a side wall, the second connecting means on the inside of the side wall; the head member mounted within the cap with the second connecting means cooperating with the first connecting means on the base to retain the head member within the cap.

11. An implement as claimed in claim 10 wherein the cap has ejector means for ejecting the head member from within the cap.

12. An implement as claimed in claim 11 wherein the ejector means comprises a flap formed in the top wall of the cap, the flap having an ejecting finger at its free end to contact the head member.

13. An implement as claimed in claim 10 wherein the second connecting means comprise a set of abutments extending radially inwardly from the inner surface of the side wall of the cap and a set of stops extending radially inwardly from the inner surface of the side wall, the stops located just above the abutments; the first connecting means comprising a circular flange on the head member, the flange located between the abutments and the stops when the head member is connected to the handle.

14. An implement as claimed in claim 13 wherein the cap has ejector means for ejecting the head member from within the cap.

15. An implement as claimed in claim 14 wherein the ejector means comprises a flap formed in the top wall of the cap, the flap having an ejecting finger at its free end to contact the head member; the flap, when pushed down, pushing the flange on the head member past the abutments on the cap.

16. An implement as claimed in claim 1 wherein the base has a cylindrical side surface forming the short handle, the side surface adapted to be held by the user when using the head member as the short handled implement.

17. An implement as claimed in claim 16 wherein the long handle has a hollow cap at the one end, the cap having a top wall and a side wall, the second connecting means on the inside of the side wall, the head member mounted within the cap and the second connecting means cooperating with the first connecting means on the head member to retain the head member within the cap.

18. An implement as claimed in claim 17 wherein the cap has ejector means for ejecting the head member from within the cap.

19. An implement as claimed in claim 18 wherein the ejector means comprise, a flap formed in the top wall of the cap, the flap having an ejecting finger at its free end to contact the head member.

20. An implement as claimed in claim 17 wherein the second connecting means comprise a set of abutments extending radially inwardly from the inner surface of the side wall of the cap and a set of stops extending radially inwardly from the inner surface of the side wall, the stops located just above the abutments; the first connecting means comprising a circular flange on the head member, the flange located between the abutments and the stops when the head member is connected to the handle.

21. An implement as claimed in claim 20 wherein the cap has ejector means for ejecting the head member from within the cap.

22. An implement as claimed in claim 21 wherein the ejector means comprises a flap formed in the top wall of the cap, the flap having an ejecting finger at its free end to contact the head member; the flap, when pushed down, pushing the flange on the head member past the abutments on the cap.

23. An implement as claimed in claim 1 wherein the handle has ejector means for ejecting the head member from the handle to separate the head member from the handle.

24. A convertible surface contacting implement having: a head member; a long handle; the head member having a base and surface contacting means carried by the base; the base hollow to form a container for liquid; the base having an inlet for introducing liquid into the container: a closure, separate from the long handle, for normally closing the inlet on the base, the closure removable from the inlet to be able to fill the container with liquid; the base having a metered opening for dispensing the liquid to the surface contacting means; the base forming a short handle; first connecting on the base and second connecting means on one end of the long handle; the implement, with the head member connected to the long handle with the first and second connecting means, forming a long handled implement with the long handle held to dispense liquid from the container through the surface contacting means; the long handled implement convertible to a short handled implement by separating the head member from the long handle and holding the base of the head member to dispense liquid from the container through the surface contacting means.

* * * * *